US008875796B2

(12) United States Patent
Hales et al.

(10) Patent No.: US 8,875,796 B2
(45) Date of Patent: Nov. 4, 2014

(54) WELL TOOL ASSEMBLIES WITH QUICK CONNECTORS AND SHOCK MITIGATING CAPABILITIES

(71) Applicant: Halliburton Energy Services, Inc., Houston, TX (US)

(72) Inventors: John H. Hales, Choctaw, OK (US); John D. Burleson, Denton, TX (US); Samuel Martinez, Cedar Hill, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/848,632

(22) Filed: Mar. 21, 2013

(65) Prior Publication Data

US 2013/0213668 A1 Aug. 22, 2013

Related U.S. Application Data

(63) Continuation of application No. 13/430,550, filed on Mar. 26, 2012, which is a continuation of application No. 13/413,588, filed on Mar. 6, 2012, now abandoned.

(51) Int. Cl.

| | |
|---|---|
| ***E21B 23/00*** | (2006.01) |
| ***E21B 43/11*** | (2006.01) |
| ***E21B 17/04*** | (2006.01) |
| ***E21B 17/07*** | (2006.01) |
| ***E21B 17/02*** | (2006.01) |
| ***E21B 43/116*** | (2006.01) |

(52) U.S. Cl.

CPC ..... *E21B 43/11* (2013.01); *E21B 17/04* (2013.01); *E21B 17/07* (2013.01); *E21B 17/02* (2013.01); *E21B 43/116* (2013.01)

USPC ..... 166/378; 166/55; 175/4.5; 285/137.11

(58) Field of Classification Search

CPC ..... E21B 43/11; E21B 17/02; E21B 43/116; E21B 17/04; E21B 17/07

USPC ..... 166/378, 55, 297, 299; 175/4.5, 4.55; 285/137.11, 141, 222, 331

See application file for complete search history.

(56) References Cited

U.S. PATENT DOCUMENTS

| | | | |
|---|---|---|---|
| 2,833,213 | A | 5/1958 | Udry |
| 2,980,017 | A | 4/1961 | Castel |

(Continued)

FOREIGN PATENT DOCUMENTS

| | | | |
|---|---|---|---|
| EP | 2065557 | A1 | 6/2009 |
| GB | 2406870 | A | 4/2005 |

(Continued)

OTHER PUBLICATIONS

Office Action issued Nov. 19, 2012 for U.S. Appl. No. 13/325,909, 43 pages.

(Continued)

*Primary Examiner* — Yong-Suk (Philip) Ro

(74) *Attorney, Agent, or Firm* — Smith IP Services, P.C.

(57) ABSTRACT

A method can include interconnecting a well tool in a well tool assembly with a shock mitigating connection, the interconnecting being performed without threading, and positioning the well tool assembly in a wellbore. A well perforating assembly can include at least two perforating devices, a detonation train extending through the perforating devices, and a shock absorber positioned between the perforating devices. A method of assembling a perforating assembly can include, prior to installing the perforating assembly in a wellbore, pushing one perforating device connector into another perforating device connector without threading the connectors together, thereby: a) preventing disconnection of the connectors and b) making a connection in a detonation train. A well system can include a perforating assembly including multiple perforating guns and multiple shock absorbers. Each shock absorber may be interconnected between at least two of the perforating guns.

25 Claims, 5 Drawing Sheets

(56) References Cited

U.S. PATENT DOCUMENTS 3,054,450 A 9/1962 Baker
3,057,296 A 10/1962 Silverman
3,128,825 A 4/1964 Blagg
3,143,321 A 8/1964 McGehee et al.
3,208,378 A 9/1965 Boop
3,216,751 A 11/1965 Der Mott
3,394,612 A 7/1968 Bogosoff et al.
3,414,071 A 12/1968 Alberts
3,653,468 A 4/1972 Marshall
3,687,074 A 8/1972 Andrews et al.
3,779,591 A 12/1973 Rands
3,923,105 A 12/1975 Lands, Jr.
3,923,106 A 12/1975 Bosse-Platiere
3,923,107 A * 12/1975 Dillard ..... 175/4.55
3,971,926 A 7/1976 Gau et al.
4,269,063 A 5/1981 Escaron et al.
4,319,526 A 3/1982 DerMott
4,346,795 A 8/1982 Herbert
4,409,824 A 10/1983 Slama et al.
4,410,051 A 10/1983 Daniel et al.
4,419,933 A 12/1983 Kirby et al.
4,480,690 A 11/1984 Vann
4,575,026 A 3/1986 Brittain et al.
4,598,776 A 7/1986 Stout
4,612,992 A * 9/1986 Vann et al. ..... 166/297
4,619,333 A 10/1986 George
4,637,478 A 1/1987 George
4,679,669 A 7/1987 Kalb et al.
4,693,317 A 9/1987 Edwards et al.
4,694,878 A 9/1987 Gambertoglio
4,764,231 A 8/1988 Slawinski et al.
4,817,710 A 4/1989 Edwards et al.
4,830,120 A 5/1989 Stout
4,842,059 A 6/1989 Tomek
4,901,802 A 2/1990 George et al.
4,913,053 A 4/1990 McPhee
4,971,153 A 11/1990 Rowe et al.
5,027,708 A 7/1991 Gonzalez et al.
5,044,437 A 9/1991 Wittrisch
5,078,210 A 1/1992 George
5,088,557 A 2/1992 Ricles et al.
5,092,167 A 3/1992 Finley et al.
5,103,912 A 4/1992 Flint
5,107,927 A 4/1992 Whiteley et al.
5,109,355 A 4/1992 Yuno
5,117,911 A 6/1992 Navarette et al.
5,131,470 A 7/1992 Miszewski et al.
5,133,419 A 7/1992 Barrington
5,161,616 A 11/1992 Colla
5,188,191 A 2/1993 Tomek
5,216,197 A 6/1993 Huber et al.
5,287,924 A 2/1994 Burleson et al.
5,343,963 A 9/1994 Bouldin et al.
5,351,791 A 10/1994 Rosenzweig
5,366,013 A 11/1994 Edwards et al.
5,421,780 A 6/1995 Vukovic
5,529,127 A 6/1996 Burleson et al.
5,547,148 A 8/1996 Del Monte et al.
5,598,894 A 2/1997 Burleson et al.
5,603,379 A 2/1997 Henke et al.
5,662,166 A 9/1997 Shammai
5,667,023 A 9/1997 Harrell et al.
5,774,420 A 6/1998 Heysse et al.
5,813,480 A 9/1998 Zaleski, Jr. et al.
5,823,266 A 10/1998 Burleson et al.
5,826,654 A 10/1998 Adnan et al.
5,957,209 A 9/1999 Burleson et al.
5,964,294 A 10/1999 Edwards et al.
5,992,523 A 11/1999 Burleson et al.
6,012,015 A 1/2000 Tubel
6,021,377 A 2/2000 Dubinsky et al.
6,068,394 A 5/2000 Dublin, Jr.
6,078,867 A 6/2000 Plumb et al.
6,098,716 A 8/2000 Hromas et al.
6,109,335 A 8/2000 Jolivet et al.
6,109,355 A 8/2000 Reid
6,135,252 A 10/2000 Knotts
6,173,779 B1 1/2001 Smith
6,216,533 B1 4/2001 Woloson et al.
6,230,101 B1 5/2001 Wallis
6,283,214 B1 9/2001 Guinot et al.
6,308,809 B1 10/2001 Reid et al.
6,371,541 B1 4/2002 Pedersen
6,394,241 B1 5/2002 Desjardins et al.
6,397,752 B1 6/2002 Yang et al.
6,408,953 B1 6/2002 Goldman et al.
6,412,415 B1 7/2002 Kothari et al.
6,412,614 B1 7/2002 Lagrange et al.
6,450,022 B1 9/2002 Brewer
6,454,012 B1 9/2002 Reid
6,457,570 B2 10/2002 Reid et al.
6,484,801 B2 11/2002 Brewer et al.
6,543,538 B2 4/2003 Tolman et al.
6,550,322 B2 4/2003 Sweetland et al.
6,595,290 B2 7/2003 George et al.
6,672,405 B2 1/2004 Tolman et al.
6,674,432 B2 1/2004 Kennon et al.
6,679,323 B2 1/2004 Vargervik et al.
6,679,327 B2 1/2004 Sloan et al.
6,684,949 B1 2/2004 Gabler et al.
6,684,954 B2 2/2004 George
6,708,761 B2 3/2004 George et al.
6,810,370 B1 10/2004 Watts, III
6,826,483 B1 11/2004 Anderson
6,832,159 B2 12/2004 Smits et al.
6,842,725 B1 1/2005 Sarda
6,868,920 B2 3/2005 Hoteit et al.
7,000,699 B2 2/2006 Yang et al.
7,006,959 B1 2/2006 Huh et al.
7,044,219 B2 5/2006 Mason et al.
7,114,564 B2 10/2006 Parrott et al.
7,121,340 B2 10/2006 Grove et al.
7,139,689 B2 11/2006 Huang
7,147,088 B2 12/2006 Reid et al.
7,165,612 B2 1/2007 McLaughlin
7,178,608 B2 2/2007 Mayes et al.
7,195,066 B2 3/2007 Sukup et al.
7,234,517 B2 6/2007 Streich et al.
7,246,659 B2 7/2007 Fripp et al.
7,260,508 B2 8/2007 Lim et al.
7,278,480 B2 10/2007 Longfield et al.
7,387,160 B2 6/2008 O'Shaughnessy et al.
7,387,162 B2 6/2008 Mooney, Jr. et al.
7,503,403 B2 3/2009 Jogi et al.
7,509,245 B2 3/2009 Siebrits et al.
7,533,722 B2 5/2009 George et al.
7,600,568 B2 10/2009 Ross et al.
7,603,264 B2 10/2009 Zamora et al.
7,640,986 B2 1/2010 Behrmann et al.
7,721,650 B2 5/2010 Barton et al.
7,721,820 B2 5/2010 Hill et al.
7,762,331 B2 7/2010 Goodman et al.
7,770,662 B2 8/2010 Harvey et al.
7,806,035 B2 10/2010 Kaiser et al.
8,126,646 B2 2/2012 Grove et al.
8,136,608 B2 3/2012 Goodman
8,397,800 B2 3/2013 Rodgers et al.
8,397,814 B2 3/2013 Rodgers et al.
8,408,286 B2 4/2013 Rodgers et al.
2002/0121134 A1 9/2002 Sweetland et al.
2003/0062169 A1 4/2003 Marshall
2003/0089497 A1 5/2003 George et al.
2003/0150646 A1 8/2003 Brooks et al.
2004/0045351 A1 3/2004 Skinner
2004/0104029 A1 6/2004 Martin
2004/0140090 A1 7/2004 Mason et al.
2006/0048940 A1 3/2006 Hromas et al.
2006/0070734 A1 4/2006 Zillinger et al.
2006/0118297 A1 6/2006 Finci et al.
2006/0243453 A1 11/2006 McKee
2007/0101808 A1 5/2007 Irani et al.
2007/0162235 A1 7/2007 Zhan et al.
2007/0193740 A1 8/2007 Quint
2007/0214990 A1 9/2007 Barkley et al.

(56) References Cited

U.S. PATENT DOCUMENTS

| | | | |
|---|---|---|---|
| 2008/0041597 | A1 | 2/2008 | Fisher et al. |
| 2008/0149338 | A1 | 6/2008 | Goodman et al. |
| 2008/0202325 | A1 | 8/2008 | Bertoja et al. |
| 2008/0216554 | A1 | 9/2008 | McKee |
| 2008/0245255 | A1 | 10/2008 | Barton et al. |
| 2008/0262810 | A1 | 10/2008 | Moran et al. |
| 2008/0314582 | A1 | 12/2008 | Belani et al. |
| 2009/0013775 | A1 | 1/2009 | Bogath et al. |
| 2009/0071645 | A1 | 3/2009 | Kenison et al. |
| 2009/0084535 | A1 | 4/2009 | Bertoja et al. |
| 2009/0151589 | A1 | 6/2009 | Henderson et al. |
| 2009/0168606 | A1 | 7/2009 | Lerche et al. |
| 2009/0182541 | A1 | 7/2009 | Crick et al. |
| 2009/0223400 | A1 | 9/2009 | Hill et al. |
| 2009/0241658 | A1 | 10/2009 | Irani et al. |
| 2009/0272529 | A1 | 11/2009 | Crawford |
| 2009/0276156 | A1 | 11/2009 | Kragas et al. |
| 2009/0294122 | A1 | 12/2009 | Hansen et al. |
| 2010/0000789 | A1 | 1/2010 | Barton et al. |
| 2010/0011943 | A1 | 1/2010 | Quinn et al. |
| 2010/0037793 | A1 | 2/2010 | Lee et al. |
| 2010/0051265 | A1 | 3/2010 | Hurst et al. |
| 2010/0085210 | A1 | 4/2010 | Bonavides et al. |
| 2010/0132939 | A1 | 6/2010 | Rodgers |
| 2010/0133004 | A1 | 6/2010 | Burleson et al. |
| 2010/0147519 | A1 | 6/2010 | Goodman |
| 2010/0230105 | A1 | 9/2010 | Vaynshteyn |
| 2012/0085539 | A1 | 4/2012 | Tonnessen et al. |
| 2012/0152519 | A1 | 6/2012 | Rodgers et al. |
| 2012/0152542 | A1 | 6/2012 | Le |
| 2012/0152614 | A1 | 6/2012 | Rodgers et al. |
| 2012/0152615 | A1 | 6/2012 | Rodgers et al. |
| 2012/0152616 | A1 | 6/2012 | Rodgers et al. |
| 2012/0158388 | A1 | 6/2012 | Rodgers et al. |
| 2012/0181026 | A1 | 7/2012 | Le et al. |
| 2012/0241169 | A1 | 9/2012 | Hales et al. |
| 2012/0241170 | A1 | 9/2012 | Hales et al. |
| 2012/0247769 | A1 | 10/2012 | Schacherer et al. |
| 2012/0318508 | A1 | 12/2012 | Glenn et al. |
| 2013/0048375 | A1 | 2/2013 | Rodgers et al. |
| 2013/0048376 | A1 | 2/2013 | Rodgers et al. |

FOREIGN PATENT DOCUMENTS

| | | | |
|---|---|---|---|
| WO | 2004076813 | A1 | 9/2004 |
| WO | 2004099564 | A2 | 11/2004 |
| WO | 2007056121 | A1 | 5/2007 |
| WO | 2013032456 | A1 | 3/2013 |

OTHER PUBLICATIONS

Office Action issued Dec. 14, 2012 for U.S. Appl. No. 13/495,035, 19 pages.
Office Action issued Dec. 18, 2012 for U.S. Appl. No. 13/533,600, 48 pages.
Australian Examination Report issued Jan. 3, 2013 for AU Patent Application No. 2010365400, 3 pages.
Office Action issued Jan. 28, 2013 for U.S. Appl. No. 13/413,588, 44 pages.
Office Action issued Jan. 29, 2013 for U.S. Appl. No. 13/430,550, 55 pages.
Office Action issued Feb. 12, 2013 for U.S. Appl. No. 13/633,077, 31 pages.
Office Action issued Jan. 27, 2012 for U.S. Appl. No. 13/210,303, 32 pages.
Office Action issued Jun. 7, 2012 for U.S. Appl. No. 13/430,550, 21 pages.
Office Action issued Mar. 21, 2013 for U.S. Appl. No. 13/413,588, 14 pages.
Office Action issued Mar. 21, 2013 for U.S. Appl. No. 13/430,550, 17 pages.
IES, Scott A. Ager; "IES Housing and High Shock Considerations", informational presentation, received Sep. 1, 2010, 18 pages.
IES, Scott A. Ager; Analog Recorder Test Example, informational letter, dated Sep. 1, 2010, 1 page.
IES, Scott A. Ager; "Series 300 Gauge", product information, dated Sep. 1, 2010, 1 page.
IES, Scott A. Ager; "IES Introduction", Company introduction presentation, received Sep. 1, 2010, 23 pages.
Petroleum Experts; "IPM: Engineering Software Development", product brochure, dated 2008, 27 pages.
International Search Report with Written Opinion issued Oct. 27, 2011 for PCT Patent Application No. PCT/US11/034690, 9 pages.
Kappa Engineering; "Petroleum Exploration and Product Software, Training and Consulting", product informational paper on v4.12B, dated Jan. 2010, 48 pages.
Qiankun Jin, Zheng Shigui, Gary Ding, Yianjun, Cui Binggui, Beijing Engeneering Software Technology Co. Ltd.; "3D Numerical Simulations of Penetration of Oil-Well Perforator into Concrete Targets", Paper for the 7th International LS-DYNA Users Conference, received Jan. 28, 2010, 6 pages.
Mario Dobrilovic, Zvonimir Ester, Trpimir Kujundzic; "Measurements of Shock Wave Force in Shock Tube with Indirect Methods", Original scientific paper vol. 17, str. 55-60, dated 2005, 6 pages.
IES, Scott A. Ager; "Model 64 and 74 Buildup", product presentation, dated Oct. 17, 2006,57 pages.
A. Blakeborough et al.; "Novel Load Cell for Measuring Axial Forca, Shear Force, and Bending Movement in large-scale Structural Experiments", Informational paper, dated Mar. 23-Aug. 30, 2001, 8 pages.
Weibing Li et al.; "The Effect of Annular Multi-Point Initiation on the Formation and Penetration of an Explosively Formed Penetrator", Article in the International Journal of Impact Engineering, dated Aug. 27, 2009, 11 pages.
Sergio Murilo et al.; "Optimization and Automation of Modeling of Flow Perforated Oil Wells", Presentation for the Product Development Conference, dated 2004, 31 pages.
Frederic Bruyere et al.; "New Practices to Enhance Perforating Results", Oilfield Review, dated Autumn 2006, 18 pages.
John F. Schatz; "Pert Breakdown, Fracturing, and Cleanup in PulsFrac", informational brochure, dated May 2, 2007, 6 pages.
M. A. Proett et al.; "Productivity Optimization of Oil Wells Using a New 3D Finite-Element Wellbore Inflow Model and Artificial Neutral Network", conference paper, dated 2004, 17 pages.
John F. Schatz; "PulsFrac Summary Technical Description", informational brochure, dated 2003, 8 pages.
IES, Scott A. Ager; "IES Recorder Buildup", Company presentation, received Sep. 1, 2010, 59 pages.
IES, Scott A. Ager; "IES Sensor Discussion", received Sep. 1, 2010, 38 pages.
IES; " Series 300: High Shock, High Speed Pressure Gauge", product brochure, dated Feb. 1, 2012, 2 pages.
Specification and drawing for U.S. Appl. No. 13/413,588, filed Mar. 6, 2012, 30 pages.
Scott A. Ager; "IES Fast Speed Gauges", informational presentation, dated Mar. 2, 2009, 38 pages.
IES; "Battery Packing for High Shock", article AN102, received Sep. 1, 2010, 4 pages.
IES; "Accelerometer Wire Termination", article AN106, received Sep. 1, 2010, 4 pages.
John F. Schatz; "PulsFrac Validation: Owen/HTH Surface Block Test", product information, dated 2004, 4 pages.
Offshore Technology Conference; "Predicting Pressure Behavior and Dynamic Shock Loads on Completion Hardware During Perforating", OTC 21059, dated May 3-6, 2010, 11 pages.
IES; "Series 200: High Shock, High Speed Pressure and Acceleration Gauge", product brochure, received Feb. 11, 2010, 2 pages.
Terje Rudshaug, et al.; "A toolbox for improved Reservoir Management", NETool, Force AWTC Seminar, Apr. 21-22, 2004, 29 pages.
Halliburton; "ShockPro Schockload Evaluation Service", Perforating Solutions pp. 5-125 to 5-126, dated 2007, 2 pages.
Halliburton; "ShockPro Schockload Evaluation Service", H03888, dated Jul. 2007, 2 pages.
Strain Gages; "Positioning Strain Gages to Monitor Bending, Axial, Shear, and Torsional Loads", p. E-5 to E-6, dated 2012, 2 pages.

(56) References Cited

OTHER PUBLICATIONS

B. Grove, et al.; "Explosion-Induced Damage to Oilwell Perforating Gun Carriers", Structures Under Shock and Impact IX, vol. 87, ISSN 1743-3509, SU060171, dated 2006, 12 pages.
WEM; "Well Evaluation Model", product brochure, received Mar. 2, 2010, 2 pages.
ENDEVCO; "Problems in High-Shock Measurement", MEGGITT brochure TP308, dated Jul. 2007, 9 pages.
John F. Schatz; "Casing Differential in PulsFrac Calculations", product information, dated 2004, 2 pages.
John F. Schatz; "The Role of Compressibility in PulsFrac Software", informational paper, dated Aug. 22, 2007, 2 pages.
"2010 International Perforating Symposium", Agenda, dated May 6-7, 2010, 2 pages.
ESSCA Group; "Erin Dynamic Flow Analysis Platform", online article, dated 2009, 1 page.
Halliburton; "Fast Gauge Recorder", article 5-110, received Nov. 16, 2010, 2 pages.
Kenji Furui; "A Comprehensive Skin Factor Model for Well Completions Based on Finite Element Simulations", informational paper, dated May 2004, 182 pages.
Halliburton; "Simulation Software for EquiFlow ICD Completions", H07010, dated Sep. 2009, 2 pages.
Specification and drawing for U.S. Appl. No. 13/377,148, filed Dec. 8, 2011, 47 pages.
Office Action issued Sep. 8, 2009, for U.S. Appl. No. 11/957,541, 10 pages.
Office Action issued Feb. 2, 2010, for U.S. Appl. No. 11/957,541, 8 pages.
Office Action issued Jul. 15, 2010, for U.S. Appl. No. 11/957,541, 6 pages.
Office Action issued Nov. 22, 2010, for U.S. Appl. No. 11/957,541, 6 pages.
Office Action issued May 4, 2011, for U.S. Appl. No. 11/957,541, 9 pages.
Office Action issued Apr. 21, 2011, for U.S. Appl. No. 13/008,075, 9 pages.
J.A. Regalbuto et al; "Computer Codes for Oilwell-Perforator Design", SPE 30182, dated Sep. 1997, 8 pages.
J.F. Schatz et al; "High-Speed Downhole Memory Recorder and Software Used to Design and Confirm Perforating/Propellant Behavior and Formation Fracturing", SPE 56434, dated Oct. 3-6, 1999, 9 pages.
Joseph Ansah et al; "Advances in Well Completion Design: A New 3D Finite-Element Wellbore Inflow Model for Optimizing Performance of Perforated Completions", SPE 73760, Feb. 20-21, 2002, 11 pages.
D.A. Cuthill et al; "A New Technique for Rapid Estimation of Fracture Closure Stress When Using Propellants", SPE 78171, dated Oct. 20-23, 2002, 6 pages.
J.F. Schatz et al; "High-Speed Pressure and Accelerometer Measurements Characterize Dynamic Behavior During Perforating Events in Deepwater Gulf of Mexico", SPE 90042, dated Sep. 26-29, 2004, 15 pages.
Liang-Biao Ouyang et al; "Case Studies for Improving Completion Design Through Comprehensive Well-Performance Modeling", SPE 104078, dated Dec. 5-7, 2006, 11 pages.
Liang-Biao Ouyang et al; "Uncertainty Assessment on Well-Performance Prediction for an Oil Producer Equipped With Selected Completions", SPE 106966, dated Mar. 31-Apr. 3, 2007, 9 pages.
B. Grove et al; "new Effective Stress Law for Predicting Perforation Depth at Downhole Conditions", SPE 111778, dated Feb. 13-15, 2008, 10 pages.
Office Action issued Jul. 17, 2013 for U.S. Appl. No. 13/430,550, 22 pages.
Office Action issued Jul. 19, 2013 for U.S. Appl. No. 13/413,588, 17 pages.
Khulief, YA et al.; "Vibration of Drillstrings With Self-Excited Stick-Slip", King Fahd University of Petroleum & Minerals, pp. 540-558, vol. 299, received Jun. 24, 2013, 2 pages.
Specification and drawing for U.S. Appl. No. 13/304,075, filed Nov. 23, 2011, 32 pages.
Specification and drawing for U.S. Appl. No. 13/314,853, filed Dec. 8, 2011, 40 pages.
Halliburton; "AutoLatch Release Gun Connector", Special Applications 6-7, received Jan. 19, 2011, 1 page.
Halliburton; "Body Lock Ring", Mechanical Downhole: Technology Transfer, dated Oct. 10, 2001, 4 pages.
Office Action issued Jun. 13, 2012 for U.S. Appl. No. 13/377,148, 38 pages.
Carlos Baumann, Harvey Williams, and Schlumberger; "Perforating Wellbore Dynamics and Gunshock in Deepwater TCP Operations", Product informational presentation, IPS-10-018, received May 11, 2011, 28 pages.
Schlumberger; "SXVA Explosively Initiated Vertical Shock Absorber", product paper 06-WT-066, dated 2007, 1 page.
International Search Report with Written Opinion issued Dec. 27, 2011 for PCT Patent Application No. PCT/US11/046955, 8 pages.
International Search Report with Written Opinion issued Jul. 28, 2011 for International Application No. PCT/US10/61104, 8 pages.
International Search Report with Written Opinion issued Nov. 22, 2011 for International Application No. PCT/US11/029412, 9 pages.
International Search Report with Written Opinion issued Jul. 28, 2011 for International Application No. PCT/US10/061107, 9 pages.
International Search Report with Written Opinion issued Oct. 27, 2011 for International Application No. PCT/US11/034690, 9 pages.
International Search Report with Written Opinion issued Nov. 30, 2011 for PCT/US11/036686, 10 pages.
Office Action issued Sep. 6, 2012 for U.S. Appl. No. 13/495,035, 28 pages.
Mexican Office Action issued Sep. 2, 2013 for MX Patent Application No. MX/a/2011/011468, 3 pages.
English Translation of Mexican Office Action issued Sep. 2, 2013 for MX Patent Application No. MX/a/2011/011468, 2 pages.
Office Action issued Sep. 13, 2013 for U.S. Appl. No. 13/210,303, 25 pages.
Office Action issued Nov. 7, 2013 for U.S. Appl. No. 13/304,075, 104 pages.
Advisory Action issued Nov. 27, 2013 for U.S. Appl. No. 13/210,303, 3 pages.
International Search Report with Written Opinion issued Mar. 22, 2011 for PCT Patent Application No. PCT/US11/029412, 9 pages.
International Search Report with Written Opinion issued Sep. 2, 2011 for PCT Patent Application No. PCT/US11/050395, 9 pages.
International Search Report with Written Opinion issued Aug. 31, 2011 for PCT Patent Application No. PCT/US11/049882, 9 pages.
Office Action issued Feb. 24, 2012 for U.S. Appl. No. 13/304,075, 15 pages.
Office Action issued Apr. 10, 2012 for U.S. Appl. No. 13/325,726, 26 pages.
Office Action issued Jul. 12, 2012 for U.S. Appl. No. 13/413,588, 42 pages.
Office Action issued Jul. 26, 2012 for U.S. Appl. No. 13/325,726, 52 pages.
Office Action issued Aug. 2, 2012 for U.S. Appl. No. 13/210,303, 35 pages.
Australian Office Action issued Sep. 21, 2012 for AU Patent Application No. 2010365400, 3 pages.
Office Action issued Oct. 23, 2012 for U.S. Appl. No. 13/325,866, 35 pages.
Office Action issued Oct. 1, 2012 for U.S. Appl. No. 13/325,726, 20 pages.
International Search Report with Written Opinion issued Feb. 9, 2012 for PCT Patent Application No. PCT/US11/050401, 8 pages.
International Search Report with Written Opinion issued Jul. 28, 2011 for International Application No. PCT/US10/61102, 8 pages.
Office Action issued Jun. 6, 2012 for U.S. Appl. No. 13/325,909, 35 pages.
Special Devices, Inc.; "Electronic Initiation System: The SDI Electronic Initiation System", online product brochure from www.specialdevices.com, received May 18, 2011, 4 pages.

(56) References Cited

OTHER PUBLICATIONS

Joseph E. Shepherd; "Structural Response of Piping to Internal Gas Detonation", article PVP2006-ICPVT11-93670, proceedings of PVP2006-ICPVT-11, dated 2006, 18 pages.
Office Action issued Dec. 12, 2012 for U.S. Appl. No. 13/493,327, 75 pages.
Office Action issued Apr. 4, 2013 for U.S. Appl. No. 13/210,303, 29 pages.
Office Action issued Jun. 11, 2013 for U.S. Appl. No. 13/493,327, 23 pages.
Office Action issued Jun. 20, 2013 for U.S. Appl. No. 13/533,600, 38 pages.
Patent Application and Drawings, filed Dec. 17, 2010, serial No. PCT/US10/61104, 38 pages.
Y.A. Khulief, et al.; "Vibration analysis of drillstrings with self-excited stick-slip oscillations", Journal of Sound and Vibration 299 (2007) 540-558, dated Oct. 2, 2006, 19 pages.
Office Action issued Jun. 29, 2012 for U.S. Appl. No. 13/325,866, 30 pages.
Office Action issued Jul. 3, 2014 for U.S. Appl. No. 13/210,303, 23 pages.
Office Action issued Mar. 12, 2014 for U.S. Appl. No. 13/304,075, 17 pages.

* cited by examiner

WELL TOOL ASSEMBLIES WITH QUICK CONNECTORS AND SHOCK MITIGATING CAPABILITIES

CROSS-REFERENCE TO RELATED APPLICATIONS

The present application is a continuation of U.S. application Ser. No. 13/430,550 filed on 26 Mar. 2012, which is a continuation of U.S. application Ser. No. 13/413,588 filed on 6 Mar. 2012, which claims priority to International application no. PCT/US2011/029412 filed on 22 disclosures of these prior applications are incorporated herein by this reference.

BACKGROUND

The present disclosure relates generally to equipment utilized and operations performed in conjunction with subterranean wells and, in an embodiment described herein, more particularly provides a well tool assembly with quick connectors and shock mitigating capabilities.

Shock absorbers have been used in the past in attempts to prevent damage to well equipment resulting from firing perforating guns and other events. In some situations, a shock absorber is interconnected between a perforating assembly and the well equipment (such as, a packer, gravel packing equipment, instruments, etc.) to be protected from shock loads.

However, testing has revealed that such shock loads are transmitted in a very short amount of time (e.g., ~10-30 milliseconds), and conventional shock absorbers are either too rigid to react adequately to the shock, or too compliant to absorb the shock. Therefore, it will be appreciated that improvements are needed in the art of mitigating shock for well assemblies.

Improvements are also needed in the art of connecting well tool assemblies. Such improvements could reduce the amount of time needed to connect perforating devices or other well tools, and could prevent damage to connectors used to connect well tools.

SUMMARY

In carrying out the principles of the present disclosure, systems and methods are provided which bring improvements to the art. One example is described below in which multiple shock absorbers are interconnected in a perforating assembly. Another example is described below in which connections are made between well tools without threading.

A method described below can include interconnecting a well tool in a well tool assembly with a shock mitigating connection, the interconnecting being performed without threading, and positioning the well tool assembly in a wellbore. The method may be used for well perforating assemblies, or for other types of well tool assemblies.

In one aspect, a well perforating assembly is disclosed. The perforating assembly can include at least two perforating devices, a detonation train extending through the perforating devices, and a shock absorber positioned between the perforating devices.

In another aspect, a method of assembling a perforating assembly is described below. The method can include, prior to installing the perforating assembly in a wellbore, pushing one perforating device connector into another perforating device connector without threading the connectors together, thereby: a) preventing disconnection of the connectors and b) making a connection in a detonation train.

In yet another aspect, a well system is provided which can include a perforating assembly including multiple perforating guns and multiple shock absorbers. Each shock absorber is interconnected between at least two of the perforating guns.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
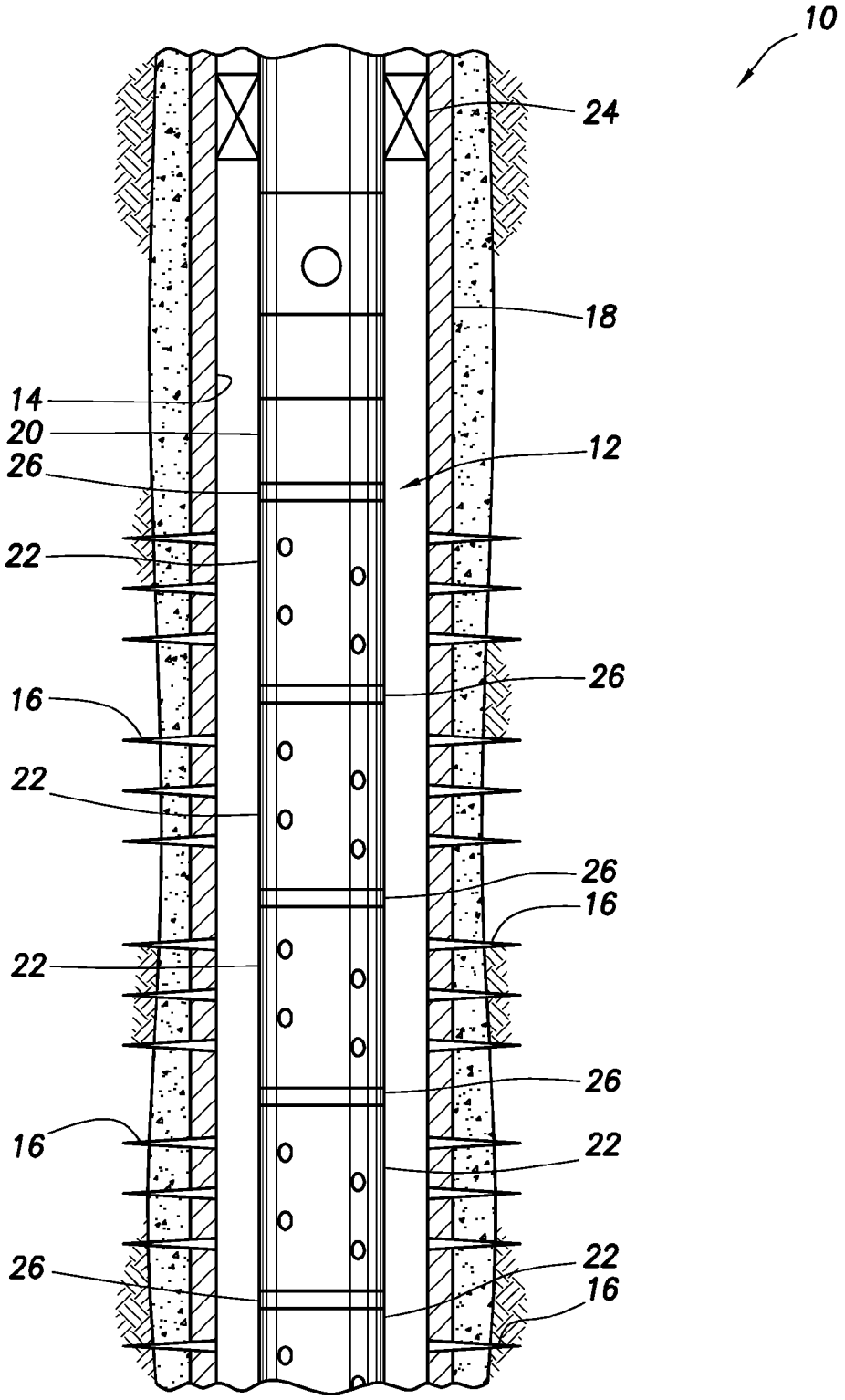
FIG. 1 is a representative partially cross-sectional view of a well system and associated method which can embody principles of the present disclosure.

Representatively illustrated in FIG. 1 is a well system 10 and associated method which can embody principles of the present disclosure. In the system 10, a perforating assembly 12 is positioned in a wellbore 14 for forming perforations 16 through casing 18 lining the wellbore.

The perforating assembly 12 can include any number of perforating devices, such as a firing head 20 and perforating guns 22. The firing head 20 fires the perforating guns 22 in response to a particular stimulus (e.g., pressure levels, pressure pulses, a telemetry signal, a bar dropped through a tubular string to the firing head, etc.). Any type of firing head, and any type of perforating guns, may be used in the perforating assembly 12 in keeping with the principles of this disclosure.

Although only one firing head 20 connected above the perforating guns 22 is depicted in FIG. 1, it will be appreciated that any number or position of firing head(s) may be used, as desired. For example, the firing head 20 could be connected at a lower end of the perforating assembly 12, multiple firing heads could be used, a separate firing head could be used for each perforating gun, etc.

In the system 10, it is desired to prevent unsetting or otherwise damaging a packer 24 set in the casing 18 above the perforating guns 22. The packer 24 is used herein as one example of a type of well equipment which can be protected using the principles of this disclosure, but it should be clearly understood that any other types of well equipment (e.g., anchors, hangers, instruments, other perforating devices, etc.) may be protected in other examples.

In one unique feature of the well system 10, a shock absorbing connection 26 is disposed between each adjacent pair of the perforating guns 22, and a shock absorbing connection is also disposed between the firing head 20 and the uppermost perforating gun. The connections 26 also allow the perforating devices (firing head 20 and perforating guns 22) to be quickly assembled to each other prior to installing the perforating assembly 12 in the wellbore 14.

Although a connection 26 is depicted in FIG. 1 between each adjacent pair of the perforating guns 22, it will be appreciated that the connections could be otherwise positioned. In other examples, some adjacent pairs of perforating guns 22 may not have the connections 26 between them. Thus, it is not necessary for each adjacent pair of perforating guns 22 to have one of the connections 26 between them, nor is it necessary for one of the connections 26 to be positioned between the firing head 20 and the adjacent perforating gun 22.

By interconnecting multiple shock absorbing connections 26 in the perforating assembly 12, each connection only has to absorb shock generated due to firing of the adjacent perforating device(s), and accumulation of the shock loads along the perforating assembly is prevented, or at least beneficially mitigated. Greater or fewer numbers of the connections 26 may be used in the perforating assembly 12 as needed to achieve a desired level of shock mitigation.

Figure 2:
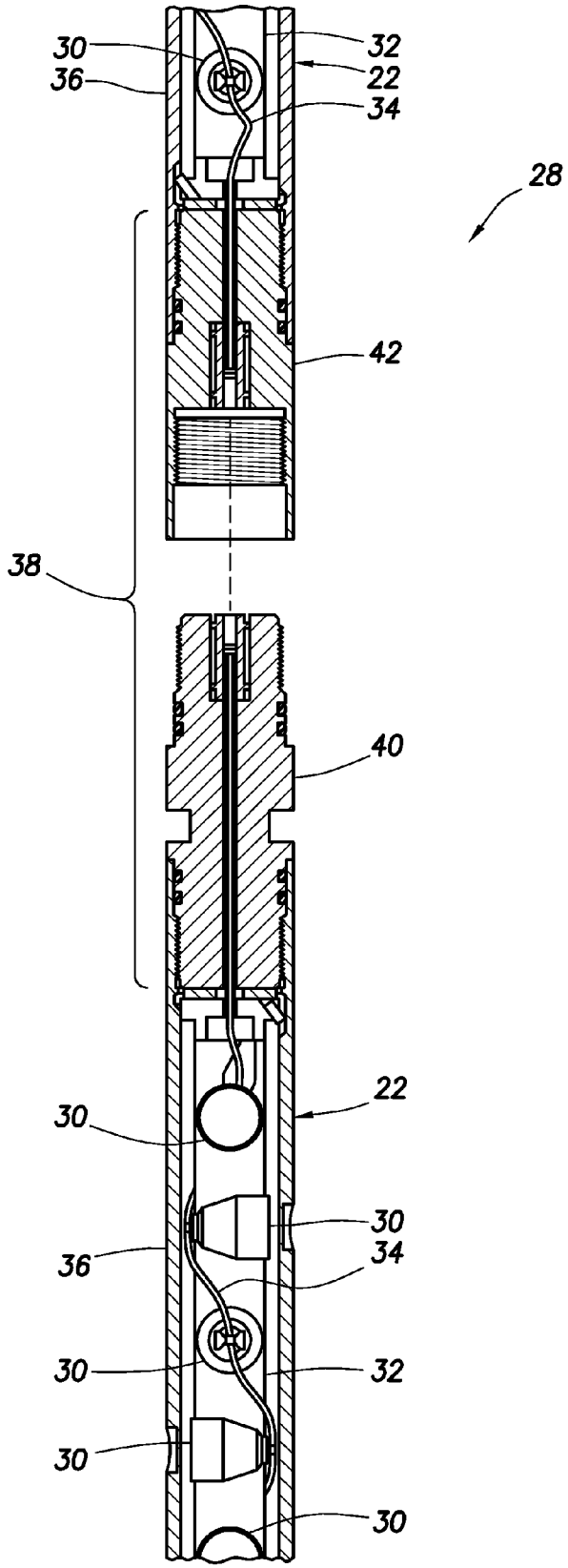
FIG.2 (PRIOR ART)
FIG. 2 is an enlarged scale representative partially cross-sectional view of a prior art perforating assembly.

Referring additionally now to FIG. 2, a partially cross-sectional view of a prior art perforating assembly 28 is representatively illustrated. The perforating assembly 28 includes the perforating guns 22, with each perforating gun including perforating charges 30, a charge carrier 32 and detonating cord 34 in a generally tubular gun body 36.

However, instead of the shock absorbing connections 26 used in the system 10, the perforating assembly 28 of FIG. 2 includes a rigid, threaded connection 38 between the perforating guns 22. Specifically, a connector 40 having opposing externally-threaded ends is threaded into one perforating gun 22, and another connector 42 having opposing externally- and internally-threaded ends is threaded into another perforating gun 22.

When the connectors 40, 42 are threaded together, the rigid, threaded connection 38 is made. The connection 38 has no shock absorbing capability, and threading the connectors 40, 42 to each other can be difficult when the guns 22 are long and/or heavy, sometimes resulting in damage to threads on the connectors.

Figure 3:
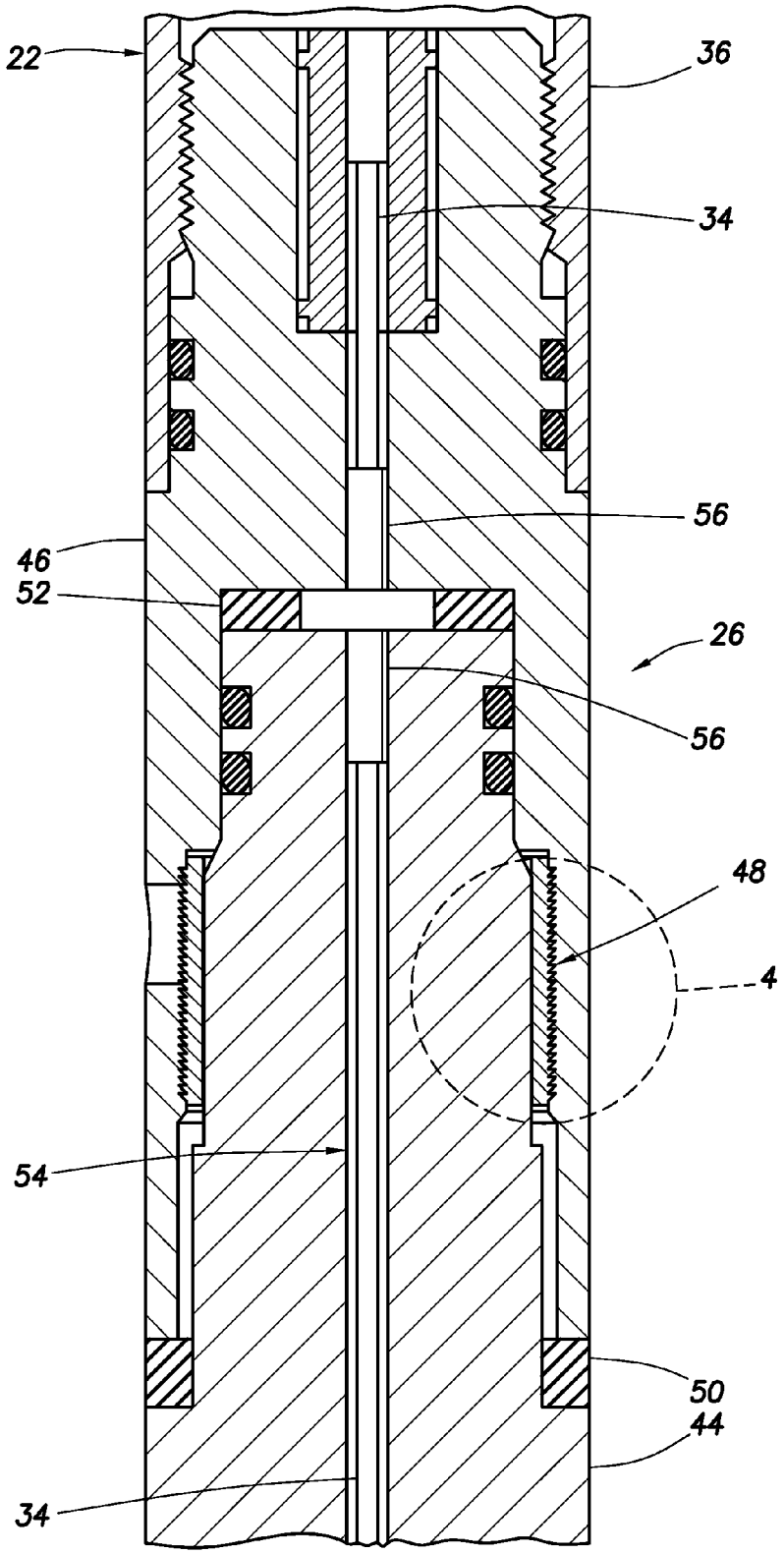
FIG. 3 is a representative cross-sectional view of a perforating assembly which can embody principles of this disclosure.

The improved connection 26 used in the system 10 is representatively illustrated in FIG. 3. The connection 26 may be used between perforating guns 22, between a perforating gun and the firing head 20, or between any other well tools or equipment. The connection 26 may also be used in perforating assemblies other than the perforating assembly 12, and in well systems other than the well system 10, in keeping with the principles of this disclosure.

The connection 26 includes a connector 44 which is attached to a perforating device (such as a perforating gun or firing head, not shown), and another connector 46 which is depicted in FIG. 3 as being attached to a perforating gun 22. The connectors 44, 46 may each be attached to the respective perforating guns 22, firing head 20 or other perforating devices or other well tools by threading or any other suitable means.

In one unique feature of the connection 26, the connector 44 can be inserted and pushed into the other connector 46 without threading. Once connected in this manner, an engagement device 48 prevents disconnection of the connectors 44, 46.

The engagement device 48 permits the connector 44 to displace in one direction longitudinally toward the other connector 46, but prevents the connector 44 from displacing in the opposite longitudinal direction relative to the connector 46. Thus, the connection 26 can be longitudinally compressed, but the device 48 prevents the connection from being elongated longitudinally.

One benefit of this arrangement is that the perforating devices or other well tools attached to the connectors 44, 46 can be quickly and conveniently connected to each other, without any need for threading the connector 44 into the other connector 46. Another benefit of this arrangement is that detonation transfer components (such as, detonation boosters 56 attached at ends of the detonating cords 34) are brought into close proximity to each other when the connector 44 is pushed into the other connector 46. In this manner, a connection is made in a detonation train 54 (including the detonating cord 34, boosters 56, etc.) which extends through the connection 26.

Another unique feature of the connection 26 is that it includes shock absorbers 50, 52 disposed between the connectors 44, 46. The shock absorbers 50, 52 function to absorb shock loads which would otherwise be transmitted through the connection 26.

The shock absorbers 50, 52 are preferably made of a material which can deform appropriately to absorb the shock loads resulting from firing of the perforating devices. Some acceptable materials for the shock absorbers 50, 52 can include brass, aluminum, rubber, foamed materials, or any other shock absorbing materials.

The shock absorbers 50, 52 may be annular-shaped as depicted in FIG. 3, or they could have any other shapes, such as round, square, T- or I-shaped cross-sections, etc. The size, shape, material and/or other characteristics of the shock absorbers 50, 52 may be customized for their placement in the perforating assembly 12, position in the well, size and length of the adjacent perforating devices or other well tools, etc.

Although two shock absorbers 50, 52 are illustrated in the connection 26 example of FIG. 3, in other examples different numbers of shock absorbers (including one) may be used. In addition, although in FIG. 3 the detonation train 54 is depicted as extending through the shock absorbers 50, 52, such an arrangement is not necessary in keeping with the principles of this disclosure.

Since the connection 26 allows for longitudinal compression of the connectors 44, 46, when a compressive shock load is transmitted to the connection, the connectors will compress somewhat, with the shock absorbers 50, 52 thereby absorbing the compressive shock load. In this manner, transmission of the shock load across the connection 26 is prevented, or is at least significantly mitigated.

Figure 4:
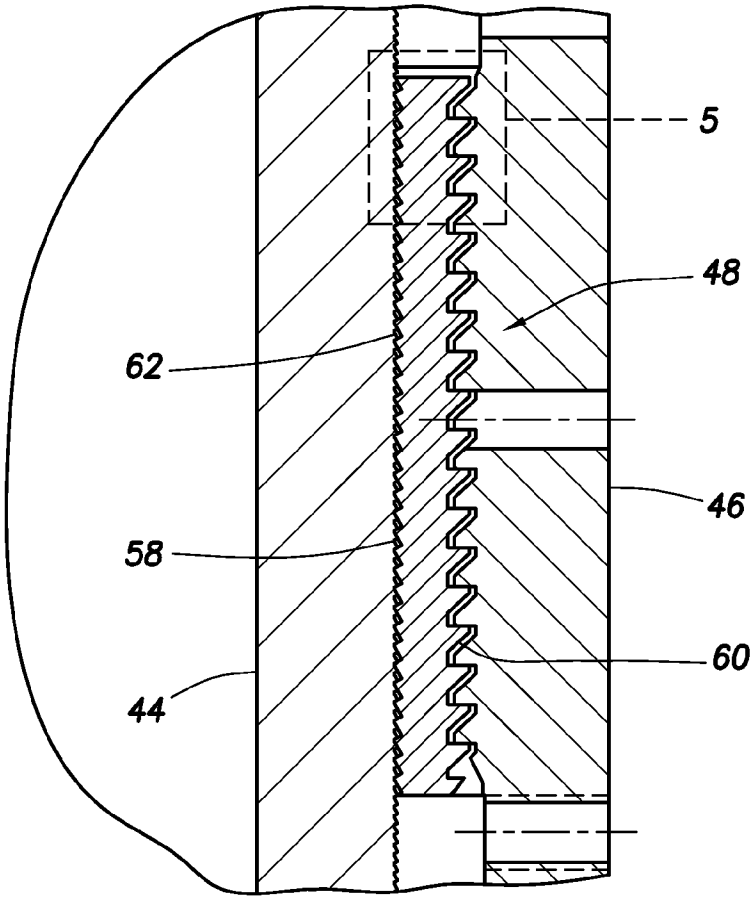
FIG. 4 is a further enlarged scale cross-sectional view of detail 4 in FIG. 3.

Referring additionally now to FIG. 4, an enlarged scale cross-sectional view of the engagement device 48 is representatively illustrated. As depicted in FIG. 4, the engagement device 48 comprises a segmented or longitudinally split sleeve 58 having a series of relatively coarse pitch ramp-type profiles 60 on an exterior thereof, and a series of relatively fine pitch profiles 62 on an interior thereof.

The profiles 60, 62 may be formed as threads on the engagement device 48, with the respective connectors 46, 44 having complementarily shaped profiles formed thereon. For example, the profiles 60 could be formed as 45-degree buttress threads, and the profiles 62 could be formed as a "phonograph" finish (very fine grooves).

However, it should be understood that, preferably, the connectors 44, 46 are not threaded to each other with the engagement device 48. Instead, the connector 44 is preferably pushed into the connector 46 (without rotating or threading either connector), and the engagement device 48 prevents the connector 44 from being withdrawn from the connector 46.

Figure 5:
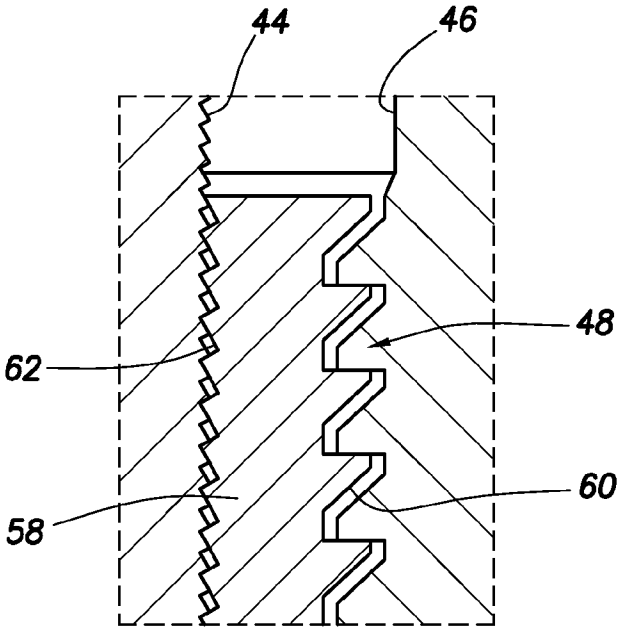
FIG. 5 is a still further enlarged scale cross-sectional view of detail 5 in FIG. 4.

In the example of FIG. 4, this result is accomplished due to the ramped interface between the profiles 60 and the connector 46, and gripping of the connector 44 by the profiles 62. A further enlarged scale view of this engagement between the connectors 44, 46 and the device 48 is representatively illustrated in FIG. 5.

If a tensile load is applied across the connection 26, the profiles 62 will grip the outer surface of the connector 44, so that the sleeve 58 attempts to displace with the connector 44. However, the ramps of the profiles 60, in engagement with the connector 46, prevent downward (as viewed in FIG. 5) displacement of the connector 44 and sleeve 58, and cause the sleeve to be compressed radially inward.

The inward compression of the sleeve 58 causes the profiles 62 to more securely grip the outer surface of the connector 44. The sleeve 58 can be formed with a C-shaped lateral cross-section, so that it can be readily deformed inward. The sleeve 58 can also be deformed radially outward, if desired, so that it no longer grips the outer surface of the connector 44, thereby allowing the connector 44 to be withdrawn from the connector 46, for example, to disassemble the perforating assembly 12 after firing, after a misfire, etc.

Although the connection 26 is described above as having multiple benefits (e.g., speed of connecting, lack of threading connectors 44, 46 to each other, shock absorbing capability, detonation train 54 connecting, etc.), it is not necessary for all of the above-described benefits to be incorporated into a single connection embodying principles of this disclosure. The connection 26 could include one of the above-described benefits, any subset of those benefits, and/or other benefits.

Figure 6:
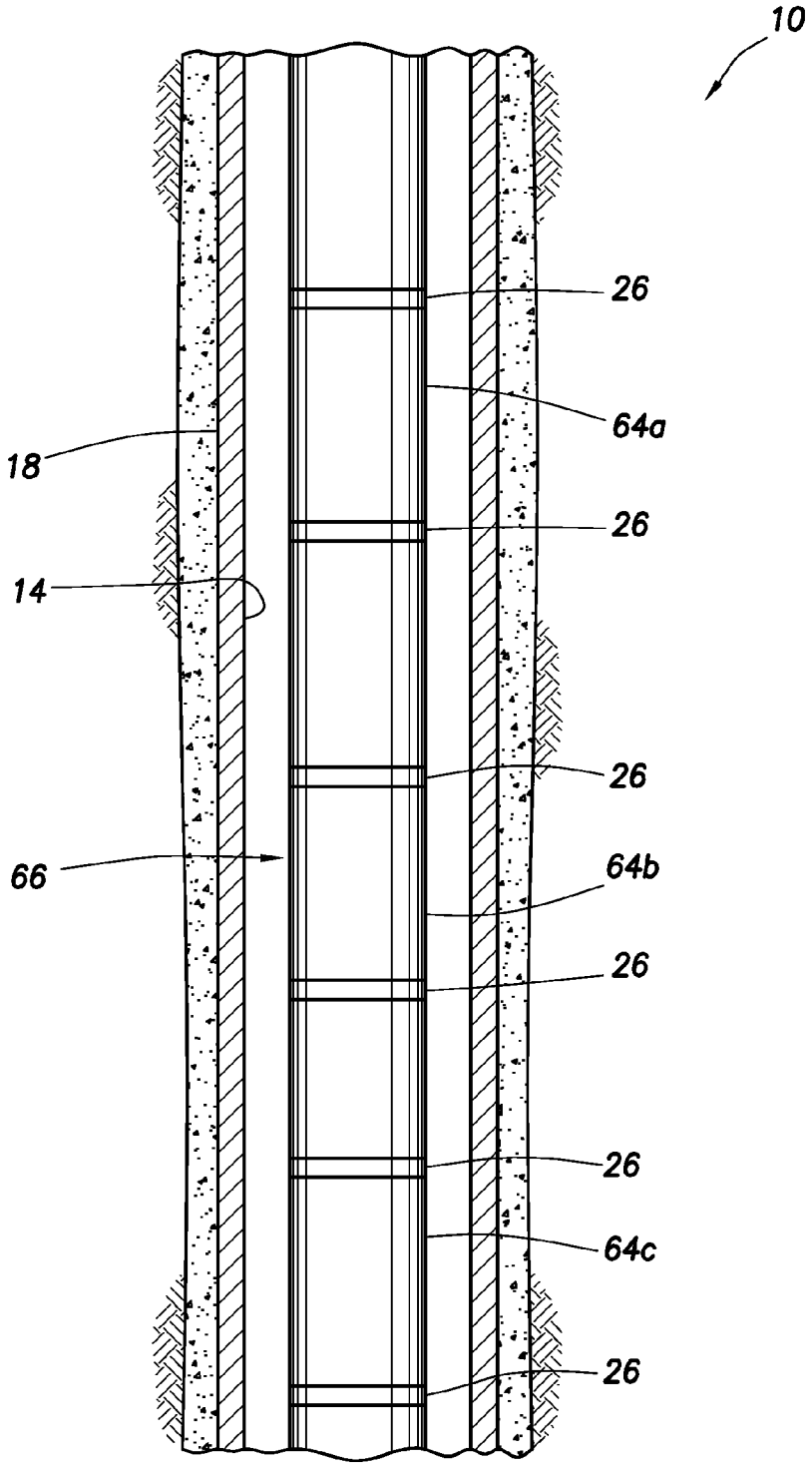
FIG. 6 is a representative partially cross-sectional view of another configuration of the well system and method.

Referring additionally now to FIG. 6, another configuration of the well system 10 is representatively illustrated. In this configuration, the connections 26 are used to prevent or mitigate shock being transmitted to various well tools 64*a-c* interconnected in a well tool assembly 66 positioned in the wellbore 14.

In this example, the well tool 64*a* comprises an instrument carrier (containing, for example, one or more pressure and/or temperature sensors, etc.), the well tool 64*b* comprises a fluid sampler (e.g., with chambers therein for containing selectively filled fluid samples), and the well tool 64*c* comprises an electronics module (e.g., used for receiving, storing and/or transmitting data, commands, etc., measuring parameters, etc.). However, it should be clearly understood that these are merely examples of well tools which can benefit from the principles of this disclosure, and any type of well tool may be used in the assembly 66 in keeping with those principles.

It is not necessary for the assembly 66 to include multiple well tools. Instead, a single well tool may benefit from use of the connections 26.

It is not necessary for the connections 26 to be used on both ends of each of the well tools 64*a-c* as depicted in FIG. 6. Instead, a connection 26 may be used on only one end of a well tool, or in positions other than the ends of a well tool.

In the example of FIG. 6, the connections 26 prevent or mitigate shock being transmitted to the well tools 64*a-c* interconnected in the assembly 66, and also allow the well tools to be interconnected in the assembly quickly and without threading. Note that the firing head 20, perforating guns 22 and packer 24 described above are also examples of well tools which can benefit from use of the connection 26.

It may now be fully appreciated that the above disclosure provides several advancements to the art. The connection 26 depicted in FIGS. 1 & 3-6 allows for shock loads to be absorbed or at least mitigated between perforating devices or other well tools, and allows perforating devices and other well tools to be connected to each other quickly and without threading.

A method described above can include interconnecting a well tool 64*a-c* in a well tool assembly 66 with a shock mitigating connection 26, the interconnecting being performed without threading, and positioning the well tool assembly 66 in a wellbore 14.

The connection 26 may comprise at least one shock absorber 50, 52 positioned between connectors 44, 46. The connection 26 may comprise a sleeve 58 having relatively coarse pitch profiles 60 on one side, and the sleeve 58 having relatively fine pitch profiles 62 on an opposite side.

Interconnecting can include pushing one connector 44 into another connector 46 without threading the connectors 44, 46 together, thereby preventing disconnection of the connectors 44, 46. An engagement device 48 may permit relative displacement between the connectors 44, 46 in one longitudinal direction, but prevent relative displacement between the connectors 44, 46 in an opposite longitudinal direction.

The well tool may be one or more of a perforating gun 22, a firing head 20, a packer 24, an instrument carrier 64*a*. a fluid sampler 64*b* and an electronics module 64*c*.

A well perforating assembly 12 described above can include at least two perforating devices (such as firing head 20, perforating gun 22, etc.), a detonation train 54 extending through the perforating devices 20, 22, and a shock absorber 50, 52 positioned between the perforating devices 20, 22.

The shock absorber 50, 52 preferably absorbs longitudinally directed shock generated by firing at least one of the perforating devices 20, 22.

The detonation train 54 may extend longitudinally through the shock absorber 50, 52.

The perforating devices may comprise perforating guns 22. The perforating devices may comprise a perforating gun 22 and a firing head 20.

The assembly 12 can include a connection 26 between the perforating devices 20, 22. An engagement device 48 of the connection 26 may permit longitudinal compression of the connection 26, but prevent elongation of the connection 26.

The connection 26 can comprise connectors 44, 46 attached to the respective perforating devices. The engagement device 48 may permit relative displacement between the connectors 44, 46 in one longitudinal direction, but prevent relative displacement between the connectors 44, 46 in an opposite longitudinal direction.

The connectors 44, 46 are preferably connected to each other without threading together the connectors 44, 46. The detonation train 54 may extend through the connectors 44, 46.

Also described above is a method of assembling a perforating assembly 12. The method can include, prior to installing the perforating assembly 12 in a wellbore 14, pushing one perforating device connector 44 into another perforating device connector 46 without threading the connectors 44, 46 together, thereby: a) preventing disconnection of the connectors 44, 46 and b) making a connection in a detonation train 54.

The method can also include positioning a shock absorber 50, 52 between the connectors 44, 46. The shock absorber 50, 52 may absorb longitudinally directed shock generated by firing at least one perforating device 20, 22. The detonation train 54 may extend longitudinally through the shock absorber 50, 52.

Each, or at least one, of the perforating device connectors 44, 46 may be attached to a perforating gun 22. At least one of the perforating device connectors 44, 46 may be attached to a firing head 20.

The above disclosure also provides to the art a well system 10. The well system 10 can comprise a perforating assembly 12 including multiple perforating guns 22 and multiple shock absorbers 50, 52.

Each shock absorber 50, 52 may be interconnected between at least two of the perforating guns 22. Each shock absorber 50, 52 preferably mitigates transmission of shock from one connector 44 to another 46, the connectors being longitudinally compressible but prevented from elongating.

A detonation train 54 may extend through the shock absorbers 50, 52.

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

In the above description of the representative embodiments of the disclosure, directional terms, such as "above," "below," "upper," "lower," etc., are used merely for convenience in referring to the accompanying drawings.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of interconnecting and securing a well tool in a well tool assembly, comprising:

interconnecting and securing the well tool in the well tool assembly with a shock mitigating connection, the shock mitigating connection being made by inserting a first connector into a second connector without relative rotation between the first and second connectors, wherein an engagement device permits relative displacement between the first and second connectors in one longitudinal direction, but prevents relative displacement between the first and second connectors in an opposite longitudinal direction; and then positioning the well tool assembly in a wellbore.

2. The method of claim 1, wherein the connection comprises at least one shock absorber positioned between the first and second connectors.

3. The method of claim 1, wherein the engagement device comprises a sleeve having relatively coarse pitch profiles on one side, and the sleeve having relatively fine pitch profiles on an opposite side.

4. The method of claim 1, wherein engagement between the first and second connectors prevents disconnection of the shock mitigating connection.

5. The method of claim 4, wherein the interconnecting and securing further comprises making a detonation train connection.

6. The method of claim 1, wherein the well tool is selected from a group comprising: a perforating gun, a firing head, a packer, an instrument carrier, a fluid sampler and an electronics module.

7. A well perforating assembly, comprising:

at least two perforating devices;

a detonation train extending through the perforating devices, the detonation train including a detonation booster; and a shock absorbing connection including a shock absorber, the shock absorbing connection being positioned between the perforating devices, wherein the detonation train extends through the shock absorbing connection, and wherein the detonation booster is disposed within the shock absorbing connection.

8. The assembly of claim 7, wherein the shock absorber absorbs longitudinally directed shock generated by firing at least one of the perforating devices.

9. The assembly of claim 7, wherein the detonation train extends longitudinally through the shock absorbing connection.

10. The assembly of claim 7, wherein the perforating devices comprise perforating guns.

11. The assembly of claim 7, wherein the perforating devices comprise a perforating gun and a firing head.

12. The assembly of claim 7, wherein the shock absorbing connection connects the perforating devices, and wherein an engagement device of the connection permits longitudinal compression of the connection, but prevents elongation of the connection.

13. The assembly of claim 12, wherein the connection comprises connectors attached to the respective perforating devices, and wherein the engagement device permits relative displacement between the connectors in one longitudinal direction, but prevents relative displacement between the connectors in an opposite longitudinal direction.

14. The assembly of claim 13, wherein the connectors are connected to each other by inserting a first connector into a second connector without relative rotation between the first and second connectors.

15. The assembly of claim 13, wherein the detonation train extends through the connectors.

16. A method of assembling a perforating assembly, the method comprising:

prior to installing the perforating assembly in a wellbore, pushing a first perforating device connector into a second perforating device connector without relative rotation between the first and second connectors, thereby: a) preventing disconnection of the first connector from the second connector and b) making a connection in a detonation train, wherein an engagement device permits relative displacement between the first and second connectors in one longitudinal direction, but prevents relative displacement between the first and second connectors in an opposite longitudinal direction.

17. The method of claim 16, further comprising positioning a shock absorber between the connectors.

18. The method of claim 17, wherein the shock absorber absorbs longitudinally directed shock generated by firing at least one perforating device.

19. The method of claim 17, wherein the detonation train extends longitudinally through the shock absorber.

20. The method of claim 16, wherein each of the perforating device connectors is attached to a perforating gun.

21. The method of claim 16, wherein at least one of the perforating device connectors is attached to a perforating gun.

22. The method of claim 16, wherein at least one of the perforating device connectors is attached to a firing head.

23. A well system, comprising:

a perforating assembly including multiple perforating guns and multiple shock absorbing connections, each shock absorbing connection including a shock absorber, wherein each shock absorbing connection is made by inserting a first connector into a second connector without relative rotation between the first and second connectors, and wherein an engagement device permits relative displacement between the first and second connectors in one longitudinal direction, but prevents relative displacement between the first and second connectors in an opposite longitudinal direction.

24. The well system of claim 23, wherein each shock absorbing connection mitigates transmission of shock, and wherein each shock absorbing connection is longitudinally compressible but prevented from elongating.

25. The well system of claim 23, wherein a detonation train extends through at least one of the shock absorbing connections, wherein the detonation train includes a detonation booster.

* * * * *